US005859587A

United States Patent [19]

Alicot et al.

[11] Patent Number: 5,859,587

[45] Date of Patent: Jan. 12, 1999

[54] DATA COMMUNICATION AND ELECTRONIC ARTICLE SURVEILLANCE TAG

[75] Inventors: Jorge F. Alicot, Davie; Richard B. Frederick, Lighthouse Point; Hubert A. Patterson, Boca Raton, all of Fla.

[73] Assignee: Sensormatic Electronics Corporation, Boca Raton, Fla.

[21] Appl. No.: 721,121

[22] Filed: Sep. 26, 1996

[51] Int. Cl.[6] ..... G08B 13/187

[52] U.S. Cl. ..... 340/572; 340/551

[58] Field of Search ..... 340/551, 572

[56] References Cited

U.S. PATENT DOCUMENTS

| | | | |
|---|---|---|---|
| 4,413,254 | 11/1983 | Pinneo et al. | 340/572 |
| 5,392,028 | 2/1995 | Pichl | 340/572 |
| 5,589,820 | 12/1996 | Robinson et al. | 340/572 |
| 5,602,527 | 2/1997 | Suenaga | 340/572 |

*Primary Examiner*—Glen Swann
*Attorney, Agent, or Firm*—Paul T. Kashimba

[57] ABSTRACT

A data communication and electronic article surveillance tag includes a data communication transponder and an electronic article surveillance tag.

23 Claims, 2 Drawing Sheets

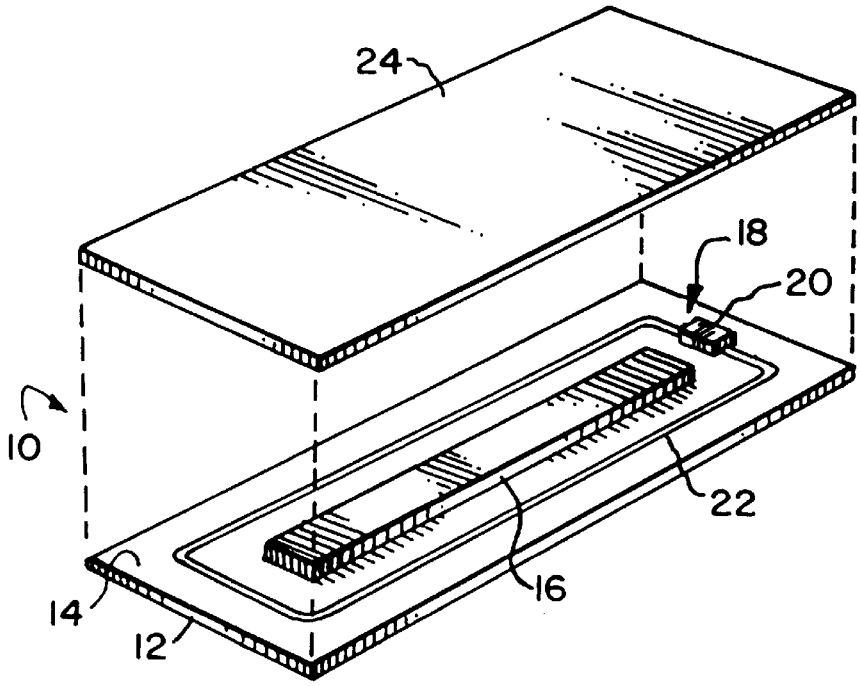
FIG. 1
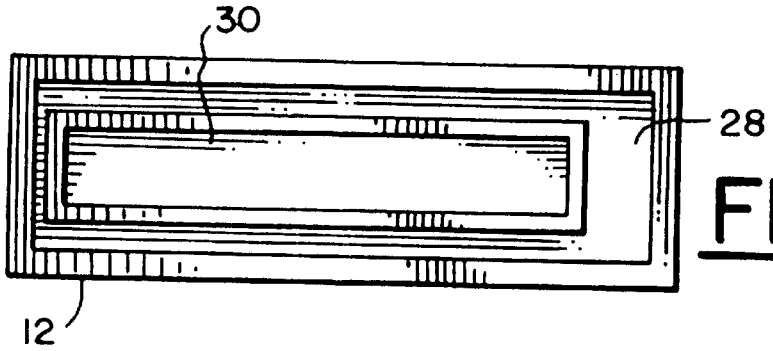
FIG. 3
FIG. 2
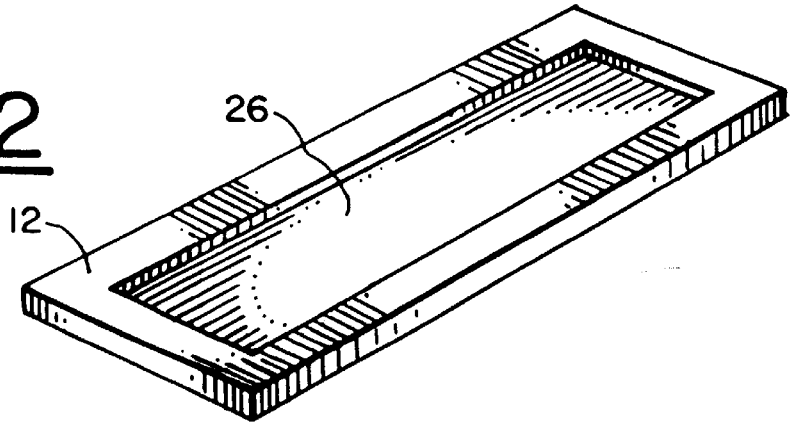

DATA COMMUNICATION AND ELECTRONIC ARTICLE SURVEILLANCE TAG

FIELD OF THE INVENTION

This invention relates to electronic article surveillance and, more particularly, to multifunction electronic article surveillance tags.

BACKGROUND OF THE INVENTION

Electronic article surveillance (EAS) systems have employed either reusable EAS tags or disposable EAS tags to monitor articles to prevent shoplifting and unauthorized removal of articles from store. The reusable EAS tags are normally removed from the articles before the customer exits the store. The disposable tags are generally attached to the packaging by adhesive or are disposed inside the packaging. These tags remain with the articles and must be deactivated before they are removed from the store by the customer. Deactivation devices use coils which are energized to generate a magnetic field of sufficient magnitude to render the EAS tag inactive. The deactivated tags are no longer responsive to the incident energy of the EAS system so that an alarm is not triggered.

In one type of deactivation system the checkout clerk passes the articles one at a time over a deactivation device to deactivate the tags and then places the articles into a shopping bag or other bulk container. This system employs one coil disposed horizontally within a housing. The clerk moves the tagged articles across the horizontal top surface of the housing such that the tag is disposed generally coplanar with the coil.

Another deactivation system utilizes a housing having a cavity with three sets of two coils each disposed around the cavity in respective x, y, and z axis planes, such that there is a coil located in a plane parallel to each side of the cavity and two coils disposed around the cavity with one being near the top and the other being near the bottom of the cavity. The checkout clerk places a bag or bulk container into the cavity and then places the tagged articles into the bag. After all of the articles have been placed into the bag or when the bag is full, the clerk energizes the coils to deactivate all of the EAS tags in the bag. The clerk then lifts the bag out of the cavity. This system provides deactivation of multiple tags at one time and does not require specific orientation of the tags.

Many retail establishments having high volumes find it desirable to expedite and facilitate the checkout process including the gathering of data about the article being purchased and the deactivation of the EAS tags. The data required by many retailers includes article identification, the price of the article, and other information for inventory control. The bar code labels in current use are limited in the amount of data that can be provided, and the checkout clerk can have difficulties getting the proper line of sight between the bar code label and bar code scanner thereby slowing the checkout process.

SUMMARY OF THE INVENTION

In accordance with the present invention there is provided a data communication and electronic article surveillance tag comprising a transponder and an electronic article surveillance tag. In one embodiment the present invention further comprises a first and second cover and the transponder and EAS tag are positioned between these covers. The covers can take various embodiments such as a film or other suitable substrate or may comprise a housing having a cavity in which the transponder and EAS tag are positioned. The antenna of the transponder can also take various embodiments in accordance with the present invention. For example, the antenna can be positioned around the EAS tag or the antenna can be embedded in one of the covers. Still further the antenna can be positioned on one of the covers by, for example, sputtering technology, metal traces or conductive ink.

In a further aspect of the invention the transponder comprises a memory that contains data about the article with which the integrated tag will be associated by attachment or positioning inside the package of the article. The data can include identification of the article and pricing of the article as well as other information to assist in the point of sale transaction and inventory control. In addition, the integrated tag can receive information such as the date and place of sale, the sales price, and manufacturer for authenticity of the article.

The multifunction tag of the present invention provides EAS protection as well as information necessary for the point of sale transaction to provide a complete solution to expedite retail checkout. High frequency radio frequency identification (RFID) tags are easily shielded or detuned by proximity to various materials and the human body, and RFID tags having small coil geometry do not provide the wide exit EAS coverage that retailers desire. However, the RFID tags are well suited to providing data about the article to which they are attached and are well suited to an expedited gathering of that data at the point of sale. An EAS tag integrated with the RFID tag provides the security needed by the retail environment.

Other objectives, advantages, and applications of the present invention will be made apparent by the following detailed description of the preferred embodiment of the invention.

DESCRIPTION OF THE DRAWINGS

FIG. I is an isometric view of one embodiment of the data and EAS tag of the present invention.

FIG. 2 is an isometric view of an alternative embodiment of the present invention.

FIG. 3 is a plan view of an alternative embodiment of the present invention.

DESCRIPTION OF PREFERRED EMBODIMENTS

Figure 4:
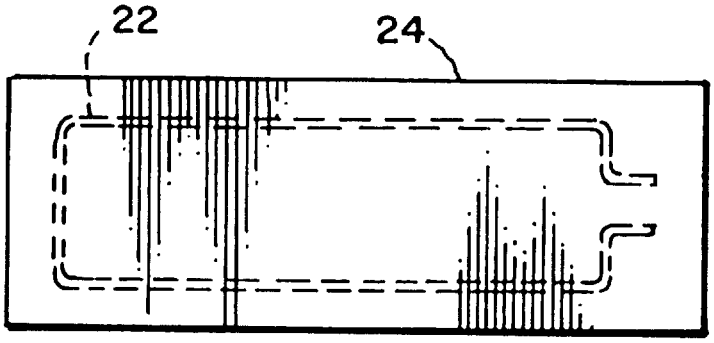
FIG. 4 is a plan view of an alternative embodiment of the present invention.

Referring to FIG. 1, a multifunction tag 10 according to one embodiment of the present invention is shown. A bottom cover 12, such as a substrate or film, has an upper surface 14 on which EAS tag 16 is positioned. Preferably EAS tag 16 is a magnetoacoustic EAS tag sold by the assignee of this application under the brand name "ULTRA•MAX®", such EAS tags are used widely for theft deterrence. However, it should be understood that other types of EAS tags can also be used such as, for example, magnetic, magnetic exhibiting a Barkhausen jump, radio frequency, and microwave. Surface 14 can have an adhesive applied to it to hold EAS tag 16 in place during assembly. Alternatively, EAS tag could have adhesive applied to it so that it remains in place on surface 14 during assembly. Cover 12 can also have an adhesive applied to its other surface for attachment to an article or the packaging for the article. A transponder 18 comprising an RFID chip 20, which can also be an RFID circuit, and an antenna 22 attached to RFID chip 20 are positioned on surface 14 such that antenna 22 is located around EAS tag 16. RFID chip 20 contains logic and memory as is known in the art, and the memory can contain data about the article to which it will be attached. This data can include identification of the article, the price of the article, and inventory control information. A cover 24, such as a film or mylar, covers EAS tag 16 and transponder 18. The surface of cover 24 which contacts surface 14, EAS tag 16, and transponder 18 can also have an adhesive to assist in bonding the parts together.

An isometric view of an alternative embodiment of the present invention is illustrated in FIG. 2. In this embodiment cover 12 is a housing that has a cavity 26 that is sized to accommodate EAS tag 16 and transponder 18 and is covered by cover 24 so that it is sealed.

FIG. 3 is a plan view of an another alternative embodiment of the present invention. In this embodiment cover 12 is a housing that has a cavity 28 that is sized to accommodate transponder 18 and a cavity 30 that is sized to accommodate EAS tag 16.

FIG. 4 illustrates a further alternative embodiment in which antenna 22 is imbedded in cover 24. Antenna 22 is then connected to RFID chip 20 during assembly. Antenna 22 is shown as a single loop; however, it can comprise multiple loops.

Figure 5:
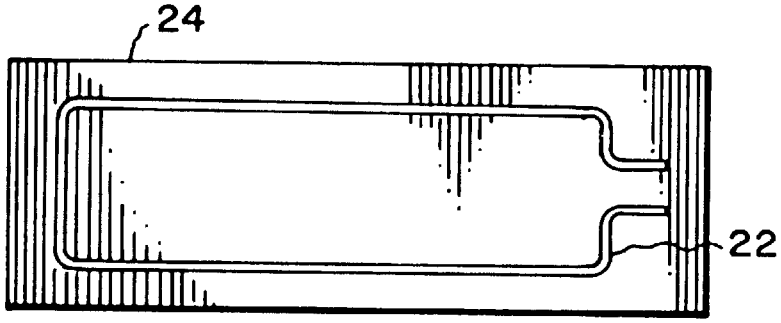
FIG. 5 is a plan view of an alternative embodiment of the present invention.

FIG. 5 illustrates still another embodiment in which antenna 22 is located on the surface of cover 24 such as by, for example, sputtering technology, metal traces or conductive ink. Antenna 22 is shown as a single loop; however, it can comprise multiple loops.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. A data communication and electronic article surveillance tag, said tag comprising: a housing a data communication transponder positioned in said housing, and an electronic article surveillance tag positioned in said housing, said electronic article surveillance tag being electrically separate from said data communication transponder.

2. A data communication and electronic article surveillance tag as recited in claim 1, wherein said housing comprises a first cover and a second cover and said data communication transponder and said electronic article surveillance tag are positioned between said first and second covers.

3. A data communication and electronic article surveillance tag as recited in claim 2, wherein said first cover has a cavity and said data communication transponder and said electronic article surveillance tag are positioned in said cavity.

4. A data communication and electronic article surveillance tag as recited in claim 3, wherein said second cover covers said cavity.

5. A data communication and electronic article surveillance tag as recited in claim 4, wherein said data communication transponder comprises an antenna positioned around said electronic article surveillance tag.

6. A data communication and electronic article surveillance tag as recited in claim 4, wherein said data communication transponder comprises a memory containing data about an article.

7. A data communication and electronic article surveillance tag as recited in claim 6, wherein said data comprises information about the pricing of an article.

8. A data communication and electronic article surveillance tag as recited in claim 2, wherein at least one of said first and second covers has an adhesive surface for attaching said tag to an article.

9. A data communication and electronic article surveillance tag as recited in claim 2, wherein said data communication transponder comprises a memory containing data about an article.

10. A data communication and electronic article surveillance tag as recited in claim 9, wherein said data comprises information about the pricing of an article.

11. A data communication and electronic article surveillance tag as recited in claim 2, wherein said data communication transponder comprises an antenna imbedded in one of said first and second covers.

12. A data communication and electronic article surveillance tag as recited in claim 2, wherein said data communication transponder comprises an antenna on one of said first and second covers.

13. A data communication and electronic article surveillance tag as recited in claim 2, wherein said first cover comprises a housing having a first cavity and a second cavity and said data communication transponder is positioned in said first cavity and said electronic article surveillance tag is positioned in said second cavity.

14. A data communication and electronic article surveillance tag as recited in claim 13, wherein said second cover covers said first and second cavities.

15. A data communication and electronic article surveillance tag as recited in claim 13, wherein said first cavity is surrounded by said second cavity and said data communication transponder comprises an antenna that is positioned in said second cavity so that said antenna is positioned around said electronic article surveillance tag.

16. A data communication and electronic article surveillance tag as recited in claim 15, wherein said electronic article surveillance tag comprises a magnetoacoustic electronic article surveillance tag.

17. A data communication and electronic article surveillance tag as recited in claim 15, wherein said data communication transponder comprises a memory containing data about an article.

18. A data communication and electronic article surveillance tag as recited in claim 17, wherein said data comprises information about the pricing of an article.

19. A data communication and electronic article surveillance tag as recited in claim 18, wherein said electronic article surveillance tag comprises a magnetoacoustic electronic article surveillance tag.

20. A data communication and electronic article surveillance tag as recited in claim 1, wherein said data communication transponder comprises an antenna positioned around said electronic article surveillance tag.

21. A data communication and electronic article surveillance tag as recited in claim 1, wherein said data communication transponder comprises a memory.

22. A data communication and electronic article surveillance tag as recited in claim 21, wherein said memory contains data about an article.

23. A data communication and electronic article surveillance tag as recited in claim 22, wherein said data comprises information about the pricing of an article.

* * * * *

UNITED STATES PATENT AND TRADEMARK OFFICE

CERTIFICATE OF CORRECTION

PATENT NO : 5,859,587
DATED : January 12, 1999
INVENTOR(S) : Alicot, et al

It is certified that error appears in the above-identified patent and that said Letters Patent are hereby corrected as shown below:

Column 2, line 40, change "FIG. I" to --FIG. 1--.

Column 3, line 44, after "housing" insert --,--.

Signed and Sealed this

Sixth Day of April, 1999

*Attest:*

Q. TODD DICKINSON

*Attesting Officer*

*Acting Commissioner of Patents and Trademarks*